United States Patent [19]

Musgrave

[11] Patent Number: 4,799,323

[45] Date of Patent: Jan. 24, 1989

[54] MAGAZINE CARRIER FOR USE ON FIREARMS OR OTHER SUPPORT

[76] Inventor: Daniel D. Musgrave, 8201 Caraway St., Cabin John, Md. 20818

[21] Appl. No.: 181,413

[22] Filed: Apr. 14, 1988

[51] Int. Cl.[4] ..... F41C 27/00

[52] U.S. Cl. ..... 42/90

[58] Field of Search ..... 42/87, 88, 90

[56] References Cited

U.S. PATENT DOCUMENTS

| | | | |
|---|---|---|---|
| 4,100,694 | 7/1978 | Musgrave | 42/90 |
| 4,115,943 | 9/1978 | Musgrave | 42/90 |
| 4,120,109 | 10/1978 | Musgrave | 42/90 |
| 4,442,962 | 4/1984 | Musgrave | 42/90 |
| 4,484,404 | 11/1984 | Johnson | 42/90 |
| 4,597,213 | 7/1986 | Musgrave | 42/90 |

*Primary Examiner*—Charles T. Jordan

[57] ABSTRACT

A magazine carrier for attachment to a firearm or other support. The carrier holds a magazine securely, yet permits it to be removed easily and quickly when needed. Only one hand is required for removal and the hand grasps the magazine in a correct orientation for insertion into a firearm. The magazine can also be removed from the carrier by a hand wearing a glove.

14 Claims, 2 Drawing Sheets

MAGAZINE CARRIER FOR USE ON FIREARMS OR OTHER SUPPORT

Many firearms use detachable magazines which can be quickly removed when empty, to be replaced by full magazines, The additional magazines are usually carried in a pouch on the person of the user. In situations where the utmost firepower is needed there is necessarily a significant delay while a magazine is removed from the pouch, properly oriented, and inserted into its receptable on the firearm.

The time required to remove the empty magazine is also significant, but some firearms are so constructed that this can be accomplished without releasing the grip of the firing hand, by pressing a release with a finger. This arrangement permits the other hand to be simultaneously reaching for a full magazine. It is readily apparent that if the full magazine is placed in a convenient location and is properly oriented, it can be quickly grasped and inserted into its receptacle on the firearm.

In addition to expediting the exchange of magazines the present invention will allow a firearm to remain unloaded, yet ready to be loaded in an extremely short time.

It is desired to point out that the word firearm is used herein in a broad sense and that it is not intended to limit the invention to any particular class of firearms. Furthermore the invention can be employed with dummy, replica, or other non-shooting "firearms".

The principal object of this invention is to provide a magazine carrier which can hold a magazine securely.

Another object is to provide such a carrier which will permit rapid removal of a magazine therefrom.

Another object is to provide such a carrier which will be economical to fabricate.

These and other objects of the present invention will become apparent upon reference to the following specification, taken in connection with the accompanying drawings wherein.

The drawings have been prepared for the purpose of disclosing the invention and they do not show any particular magazine. In actual practice the invention can be applied to carriers for magazines differing in configuration from that used as an example. The carrier shown is merely exemplary. The drawings should not be construed as limitations on the invention.

Figure 1:
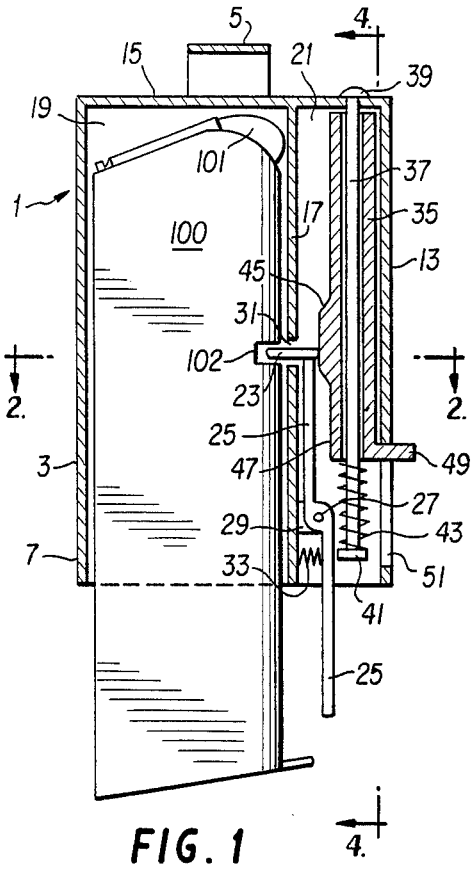
FIG. 1 is a longitudinal section of a magazine carrier with a magazine installed therein.

Referring to the drawings in detail, FIG. 1 shows a magazine carrier 1, having a housing 3 made of any suitable material such as a metal or a plastic. At the top of the housing is loop 5, by which the housing may be attached to a supporting structure, which might be a firearm, a vehicle, or the clothing or equipment of a user. Other types of attachment devices can be used instead of the loop, if desired.

The housing comprises sides 7, 9, 11, and 13, and roof 15. A partition 17 divides the housing into a magazine receptacle 19 and a detent box 21. For convenience, these will be referred to as the receptacle, and the box, respectively.

A magazine 100 is installed in the receptacle, which encompasses the upper portion of the magazine. A cartridge 101 is visible at the upper end of the magazine. The magazine is slideable into and out of the receptacle and it is latched therein by a claw 23 which is engaged with a notch 102 formed in the body of the magazine in a well known manner. The notch is of a type frequently used to retain magazines in firearms, but the claw can be arranged to cooperate with various types of surfaces on magazines.

Claw 23 is affixed to lever 25 which is pivotable on pin 27, the pin being supported on a pair of brackets 29, said brackets being affixed to partition 17 in any convenient manner.

Through the partition is formed a hole 31, through which the claw can protrude into the receptacle to engage a magazine therein.

Between the partition and the lower portion of the lever is positioned a spring 33, the effect of which is to bias the lever in such a direction that the claw tends to protrude into the receptacle.

Installed in box 21 is a detent arranged to prevent inadvertent movement of the lever. The detent comprises a wedge 35, slideably mounted on a rod 37, the wedge including a longitudinal hole in which it encompasses the rod. The rod passes through a suitable hole in roof 15 and terminates in a flange 39.

The lower end of the rod is affixed to a shelf 41 which is supported in any convenient manner on side 11 of the box. Between the shelf and the slideable wedge a spring 43 encircles the rod. The effect of the spring is to bias the wedge upward in the box.

Formed on the wedge is cam 45, the purpose of which will be explained later. Although the wedge can slide vertically on the rod its orientation around the vertical axis is determined by contact with sides 11 and 13. The lower portion of the wedge is cut away at 47 to clear other elements in its path when sliding downward.

The wedge is provided with a handle 49 which passes through a slot 51 formed in side 13 of the box.

The lower ends, of both the receptacle and of the box, are open. An installed magazine will extend below the receptacle. The lower end of lever 25 extends below the box.

Claw 23 and lever 25 extend substantially at a right angle to each other. Extending at a right angle to both the claw and the lever, and affixed to both, is a bar 53, which rests against partition 17 when the claw protrudes through hole 31 a sufficient distance to engage a magazine in the receptacle. The purpose of the bar will be explained later.

Figure 4:
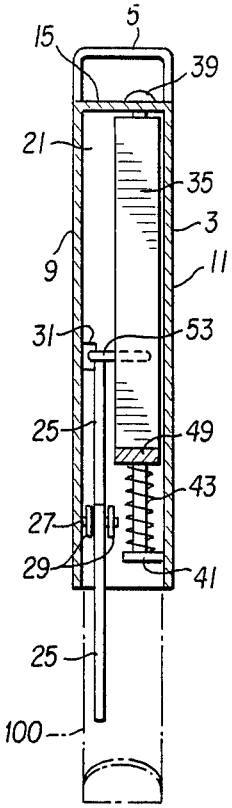
FIG. 4 is a cross section, taken in the plane indicated by arrows 4—4 on FIG. 1.
Figure 2:
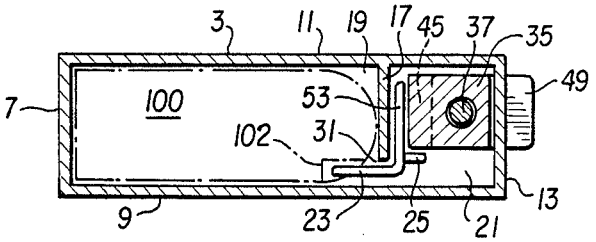
FIG. 2 is a horizontal section, taken in the plane indicated by arrows 2—2 on FIG. 1.

The operation of the embodiment described above is as follows. It is assumed that the carrier is in the condition shown in FIGS. 1, 2, and 4, and that it is suspended from a support by loop 5. It is desired to quickly remove magazine 100 from carrier 1. To do so it will be necessary to disengage claw 23 from slot 102. This requires that lever 25 be pivoted in a clockwise direction around pin 27.

But movement of the lever is prevented by cam 45 on the wedge which is blocking bar 53 on the lever. The dimensions of the wedge can be so chosen that it is a close fit between the bar and side 13 of the box. This blocking is maintained by spring 43 which pushes the wedge upward in the box.

Figure 5:
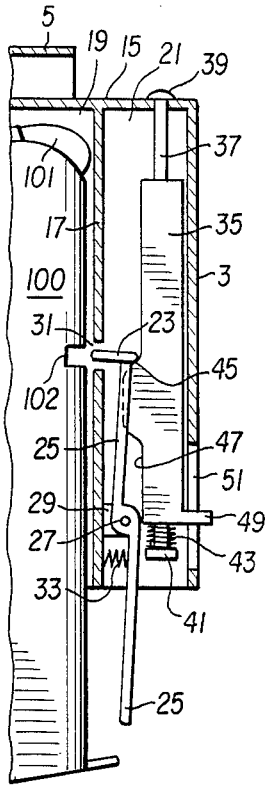
FIG. 5 is similar to FIG. 1, but some parts have been moved.
Figure 3:
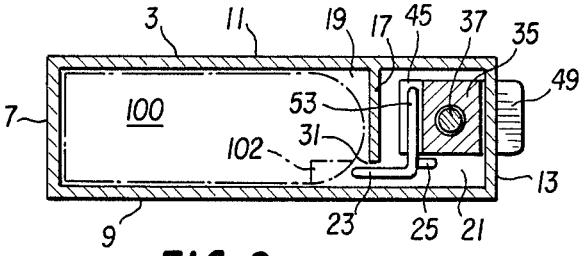
FIG. 3 is similar to FIG. 2, but some parts have been moved.

To move the lever it is therefore necessary to pull the wedge downward, by means of handle 49, to the position shown in FIG. 5. There, the cam is no longer blocking bar 53, and the lever has been pivoted, disengaging claw 23 from slot 102. This condition can be understood by referring to FIGS. 3 and 5 wherein the claw is out of the slot and the magazine is free to slide out of the receptacle.

To perform the above-described operation the user grasps the housing with his hand touching handle 49 and slides the hand downward. The handle is thus pulled down, and as the lever becomes free to move, the hand tightens its grip on the lever and the magazine. The magazine is released into the hand.

Figure 6:
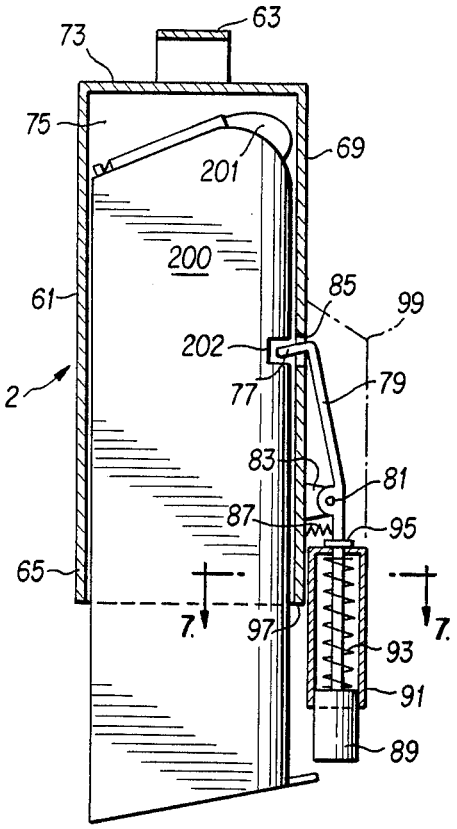
FIG. 6 is a longitudinal section of a magazine carrier with a magazine installed therein, but with details varying from those of the embodiment shown in FIG. 1.
Figure 8:
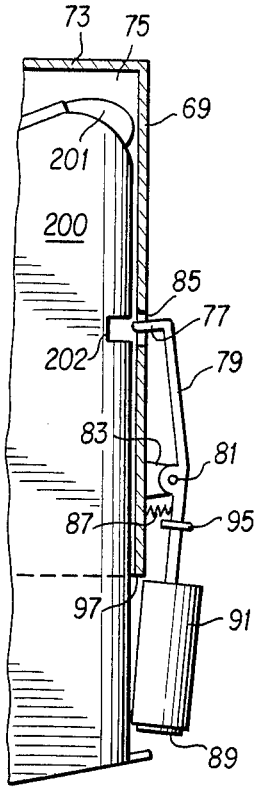
FIG. 8 is similar to FIG. 6, but some parts have been moved.
Figure 7:
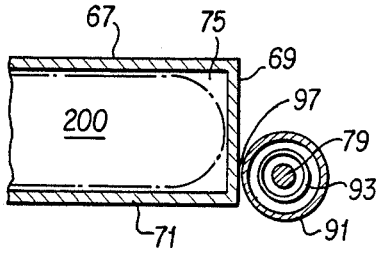
FIG. 7 is a horizontal section, taken in the plane indicated by arrows 7—7 on FIG. 6.

Referring now to FIGS. 6, 7, and 8, another embodiment of this invention is disclosed. FIG. 6 shows a magazine carrier 2, having a housing 61 made of any suitable material such as a metal or a plastic. At the top of the housing is loop 63, by which the housing may be attached to a supporting structure. Various types of attachment devices may be used, other than a loop.

The housing comprises sides 65, 67, 69, and 71, and roof 73. The lower end of the housing is open.

The interior of the housing forms a magazine receptacle 75, which closely encompasses the upper portion of a magazine 200 installed therein. A cartridge 201 is visible at the upper end of the magazine. The magazine is slideable into and out of the receptacle and it is retained therein by a claw 77 which is engaged with a notch 202 formed in the body of the magazine in a well known manner.

Both embodiments desclosed in this specification are shown with a housing having closed sides. But an open frame could as well serve as the magazine engagement means of the invention. The words magazine engagement means will be used herein to indicate either type or equivalent elements. These means may encompass the full length of a magazine, or only a portion thereof.

Claw 77 is affixed to lever 79 which is pivotable on pin 81, the pin being supported on a pair of brackets 83, only one of which is visible in the drawings. The brackets are fixed to side 69 by any convenient method.

Through side 69 is formed hole 85 to permit the claw to protrude into the receptacle to engage a magazine therein. A spring 87 is positioned between side 69 and lever 79 so as to bias the lever in such a direction that the claw will tend to protrude into the receptacle.

On the lower end of the lever is fixed a piston 89. A cylinder 91 slideably encompasses the lever and the piston. To permit this, the cylinder is open at the lower end to accommodate the piston, and has a suitable central hole at the upper end to surround the lever. This hole is shaped substantially to the profile of the cross section of the lever.

Within the cylinder, a spring 93 encircles the lever and bears against the piston and the interior face of the top of the cylinder. The effect is to bias the cylinder upward. A collar 95 is positioned on the lever to limit upward travel of the cylinder.

Operation of the embodiment disclosed in FIGS. 6, 7, and 8 is as follows. It is assumed that the carrier is in the condition shown in FIG. 6, and that it is suspended from a support by loop 63. It is desired to quickly remove magazine 200 from carrier 2. To do so it will be necessary to disengage claw 77 from notch 202, as the magazine cannot slide out of the receptacle while the claw is thus engaged. To disengage the claw requires that the lever be pivoted in a clockwise direction around pin 81.

But movement of the lever is blocked because cylinder 91 is in contact with the lower portion 97 of side 69 of the magazine engagement means, i.e., housing 61. This can be clearly understood by reference to FIGS. 6 and 7. The cylinder, in effect, acts as a wedge.

To release the lever it is merely necessary to move the cylinder down to the position shown in FIG. 8, where it is below portion 97 and can not block movement of the lever.

To perform the above-described operation, the user grasps the housing with his hand above the cylinder and slides the hand downward. The cylinder can thus be pulled down and the lever pivoted in a single motion. As soon as the claw releases the magazine, the hand will instinctively grasp the magazine and remove it from the receptacle.

To provide a smooth surface for the above described method of removal, a simple shield can be affixed to side 69 in order to cover the upper part of the lever. Such a shield is indicated by broken lines 99. The shield can be attached to the housing in any convenient manner.

Figure 9:
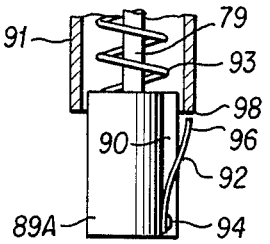
FIG. 9 shows an additional feature which can be applied to a carrier such as that shown in FIG. 6.

FIG. 9 shows an additional, optional, safety feature adapted to block inadvertent movement of the cylinder. Piston 89A differs from pison 89 in that a longitudinal slot 90 is formed therein. A stiff curved spring 92 has one end 94 fixed in the slot in any convenient manner. The other end 96 of the spring is positioned close to the lower end 98 of cylinder 91. When the cylinder is in contact with collar 95, there is a slight gap between end 96 of the spring and end 98 of the cylinder. If the cylinder is inadvertently moved downward, it will be blocked after traveling the distance necessary to close the gap. This prevents unintentional movement of the cylinder to the position shown in FIG. 8.

Assuming this additional feature to be applied to the embodiment shown in FIGS. 6, 7, and 8, operation would be as already described for said embodiment but of course end 96 of spring 92 must be pressed into slot 90 before the cylinder can move down below end 97 of the housing. As the cylinder moves down it will retain end 96 within the slot.

With this additional feature the user would press the blocking spring into the slot with one finger as he grasps the housing and cylinder with his hand. Of course, other equivalent mechanical elements can be included as the detent blocking means.

The detent means of this invention comprises wedge 35 and bar 53; or cylinder 91 and portion 97 of the housing; or mechanical equivalents for those elements.

The latch means of this invention comprises the disclosed levers and claws, the slots in which the claws engage, or mechanical equivalents for those elements.

There is thus disclosed a simple magazine carrier, which can hold a magazine securely yet will release it into the hand of the user in a minimum elapsed time.

I claim:

1. A carrier for a cartridge magazine, said carrier comprising: a housing adapted for slideably encompassing a magazine installed therein; means for attaching said housing to a supporting structure; pivotable latch means on said housing, said latch means adapted at a first orientation to prevent said magazine from sliding out of said housing; said latch means adapted at a second orientation to permit said magazine to slide out of said housing; and releaseable detent means adapted at a first position to prevent movement from said first to said second orientation, said detent means positioned on said latch means; said detent means adapted at a second position to permit said movement.

2. A carrier as set forth in claim 1 wherein said means for attaching said housing to a supporting structure comprises a loop.

3. A carrier as set forth in claim 1 wherein said latch means is biased toward said first orientation.

4. A carrier as set forth in claim 1 wherein said housing serves as a cover for a feed end of a magazine.

5. A carrier as set forth in claim 1 wherein said housing comprises four contigous sides and a top contigous with said four sides.

6. A carrier as set forth in claim 1 wherein said detent means comprises wedge means positionally adapted for preventing movement of said latch means from said first to said second orientation.

7. A carrier for a cartridge magazine, said carrier comprising: a housing adapted for slideably encompassing a magazine installed therein; means for attaching said housing to a supporting structure; pivotable latch means on said housing, said latch means adapted at a first orientation to prevent said magazine from sliding out of said housing; said latch means adapted at a second orientation to permit said magazine to slide out of said housing; and releaseable detent means engageable with said latch means at a first position to prevent movement from said first to said second orientation, said detent means movably positioned on said housing; said detent means adapted at a second position to permit said movement.

8. A carrier for a cartridge magazine, said carrier comprising; magazine engagement means adapted for slideably encompassing a portion of a magazine installed therein; means for attaching said magazine engagement means to a supporting structure; movable latch means on said magazine engagement means, said latch means adapted at a first position for contacting a surface on said magazine whereby said magazine is retained within said magazine engagement means; said latch means movable to a second position on said magazine engagement means whereat said latch means cannot contact said surface; and releaseable detent means positionally adapted to prevent movement from said first to said second position, said detent means positioned on said latch means.

9. A carrier as set forth in claim 8 wherein said means for attaching said magazine engagement means to a supporting structure comprises a loop.

10. A carrier as set forth in claim 8 wherein said latch means is pivotable relative to said magazine engagement means.

11. A carrier as set forth in claim 10 wherein said latch means is biased in a predetermined direction relative to said magazine engagement means.

12. A carrier as set forth in claim 8 wherein said surface is an edge of a notch in said magazine.

13. A carrier as set forth in claim 8 wherein said detent means is slideable.

14. A carrier for a cartridge magazine, said carrier comprising: magazine engagement means adapted for slideably encompassing a portion of a magazine installed therein; means for attaching said magazine engagement means to a supporting structure; movable latch means on said magazine engagement means, said latch means adapted at a first position for contacting a surface on said magazine whereby said magazine is retained within said magazine engagement means; said latch means movable to a second position on said magazine engagement means whereat said latch means cannot contact said surface; and releaseable detent means positionally adapted to prevent movement from said first to said second position, said detent means movably positioned on said magazine engagement means.

* * * * *